US007441694B2

(12) United States Patent
Kenny

(10) Patent No.: US 7,441,694 B2
(45) Date of Patent: Oct. 28, 2008

(54) CONTAINER

(75) Inventor: Rochè Kenny, Rawsonville (ZA)

(73) Assignee: APL Cartons Pty Ltd, Worcester (ZA)

( * ) Notice: Subject to any disclaimer, the term of this patent is extended or adjusted under 35 U.S.C. 154(b) by 413 days.

(21) Appl. No.: 10/550,029

(22) PCT Filed: Apr. 2, 2004

(86) PCT No.: PCT/ZA2004/000037

§ 371 (c)(1),
(2), (4) Date: Sep. 23, 2005

(87) PCT Pub. No.: WO2004/087512

PCT Pub. Date: Oct. 14, 2004

(65) Prior Publication Data

US 2006/0213960 A1 Sep. 28, 2006

(30) Foreign Application Priority Data

Apr. 3, 2003 (ZA) ..... 03/2606

(51) Int. Cl.
*B65D 25/54* (2006.01)
*B65D 43/14* (2006.01)
*B65D 21/032* (2006.01)

(52) U.S. Cl. ..... 229/125.31; 229/162.7; 229/174; 229/915

(58) Field of Classification Search ..... 229/125.015, 229/125.31, 172, 174, 915, 918, 919, 162.1, 229/162.7
See application file for complete search history.

(56) References Cited

U.S. PATENT DOCUMENTS

| | | | | | |
|---|---|---|---|---|---|
| 1,600,260 | A | | 9/1926 | Walter | |
| 1,616,014 | A | | 2/1927 | Walter | |
| 1,894,226 | A | | 1/1933 | Ross | |
| 2,334,902 | A | | 11/1943 | Buttery | |
| 2,572,159 | A | * | 10/1951 | Kells et al. | 229/149 |
| 2,648,427 | A | * | 8/1953 | Langford | 229/162.7 |
| 3,010,635 | A | * | 11/1961 | Sheldon-Williams | 229/169 |
| 3,270,875 | A | | 9/1966 | Burt | |
| 3,797,728 | A | | 3/1974 | Buttery et al. | |
| 3,861,578 | A | * | 1/1975 | McHan | 206/521.1 |
| 4,082,215 | A | * | 4/1978 | Eichenauer | 229/120 |

(Continued)

FOREIGN PATENT DOCUMENTS

FR A 1387 119 1/1965

(Continued)

OTHER PUBLICATIONS

International Search Report No. PCT/ZA2004/000037 dated Jul. 15, 2005, 3 pages.

*Primary Examiner*—Gary E Elkins
(74) *Attorney, Agent, or Firm*—Connolly Bove Lodge & Hutz LLP

(57) ABSTRACT

A container is disclosed. The container includes a base panel, end wall panels upstanding from opposed ends of the base panel, side wall panels upstanding from opposed sides of the base panel, flaps attached to the end wall panels and extending along the side edges of the base panel inwardly of said side wall panels, and a cover extending over the open top of the container and having its edges secured between said side wall panels and said flaps.

2 Claims, 6 Drawing Sheets

U.S. PATENT DOCUMENTS 4,513,907 A * 4/1985 Grosshuesch ..... 229/122.27
4,600,142 A * 7/1986 Quaintance ..... 229/143
4,741,435 A * 5/1988 Clarke ..... 220/377
4,787,515 A * 11/1988 Stoll ..... 206/509
5,704,193 A * 1/1998 Roe et al. ..... 53/397
5,881,949 A * 3/1999 Focke ..... 229/125.31
6,427,907 B1 * 8/2002 Espinoza et al. ..... 229/122
6,938,820 B2 * 9/2005 Noone et al. ..... 229/176
7,004,378 B1 * 2/2006 Tharpe, Jr. ..... 229/174

FOREIGN PATENT DOCUMENTS

FR 2530 221 A 1/1984
GB 528 289 A 10/1940

* cited by examiner

CONTAINER

FIELD OF INVENTION

THIS INVENTION relates to a container and to a container blank.

BRIEF DESCRIPTION OF THE INVENTION

According to the invention there is provided a container which includes:

a base panel;

end wall panels upstanding from opposed ends of the base panel;

side wall panels upstanding from opposed sides of the base panel;

flaps attached to the end wall panels and extending along the side edges of the base panel inwardly of said side wall panels; and a cover extending over the open top of the container and having its edges secured between said side wall panels and said flaps.

In a preferred form of the invention each side wall panel may have a horizontally extending crease line across it which sub-divides it into an upper panel part and a lower panel part.

The horizontally extending crease line may be formed by a reverse score.

The cover may be a net or a length of plastics material.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 6:
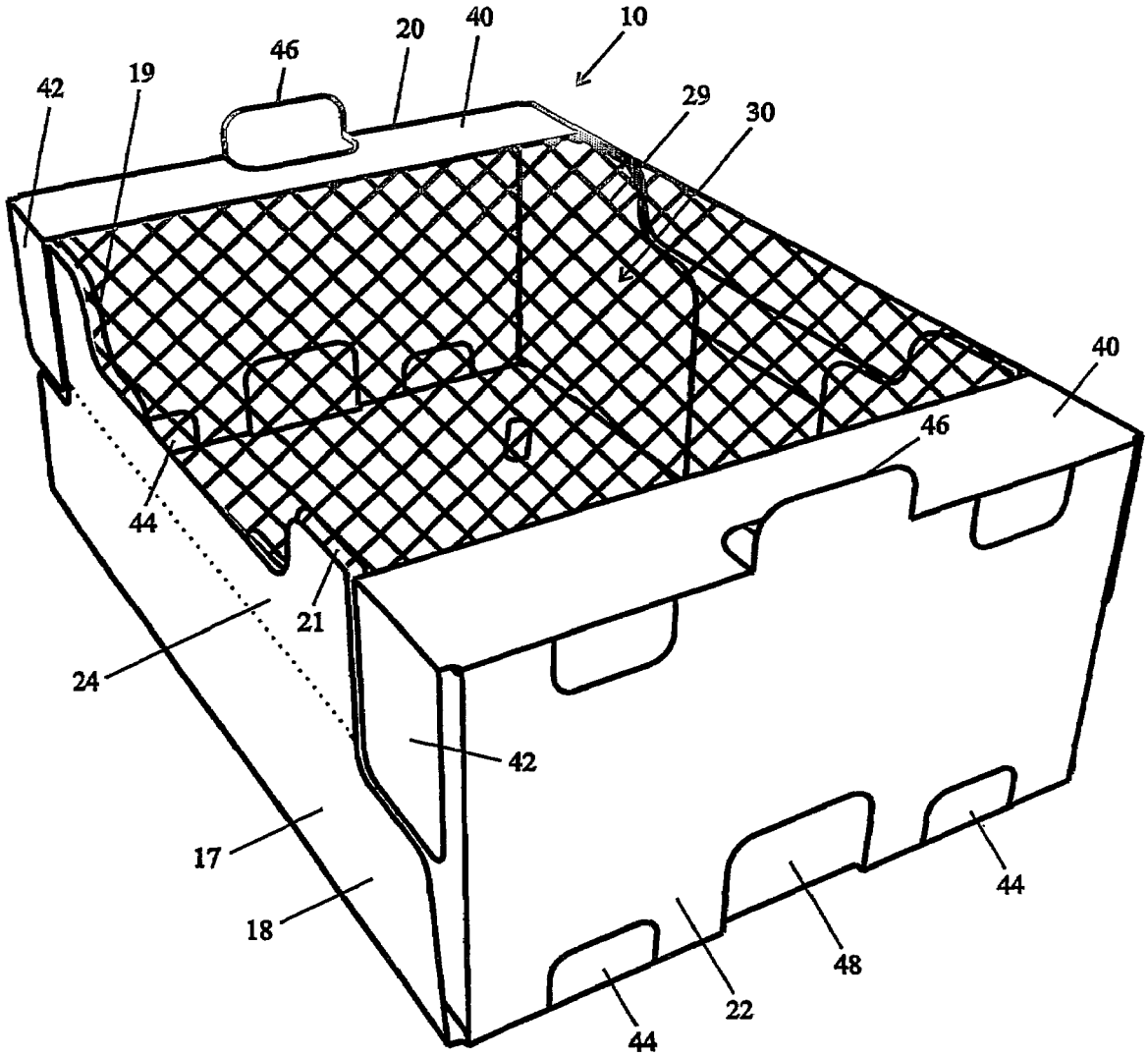
FIG. 6 shows a pictorial view of the container having a cover means secured thereto.

A container 10 according to the invention is shown in FIG. 6. The container 10 is formed from the foldable unitary blank 12 shown in FIG. 1.

The blank 12 is preferably formed of corrugated polymeric sheet material, cardboard, card or composite board material. The container 10 may also be of a plastics material.

Container 10 is intended for the convenient storage, shipping and displaying of perishable goods such as fruit or confectionary. The fruit may consist of various types such as, for example, citrus, grapes, peaches, or the like.

Figure 1:
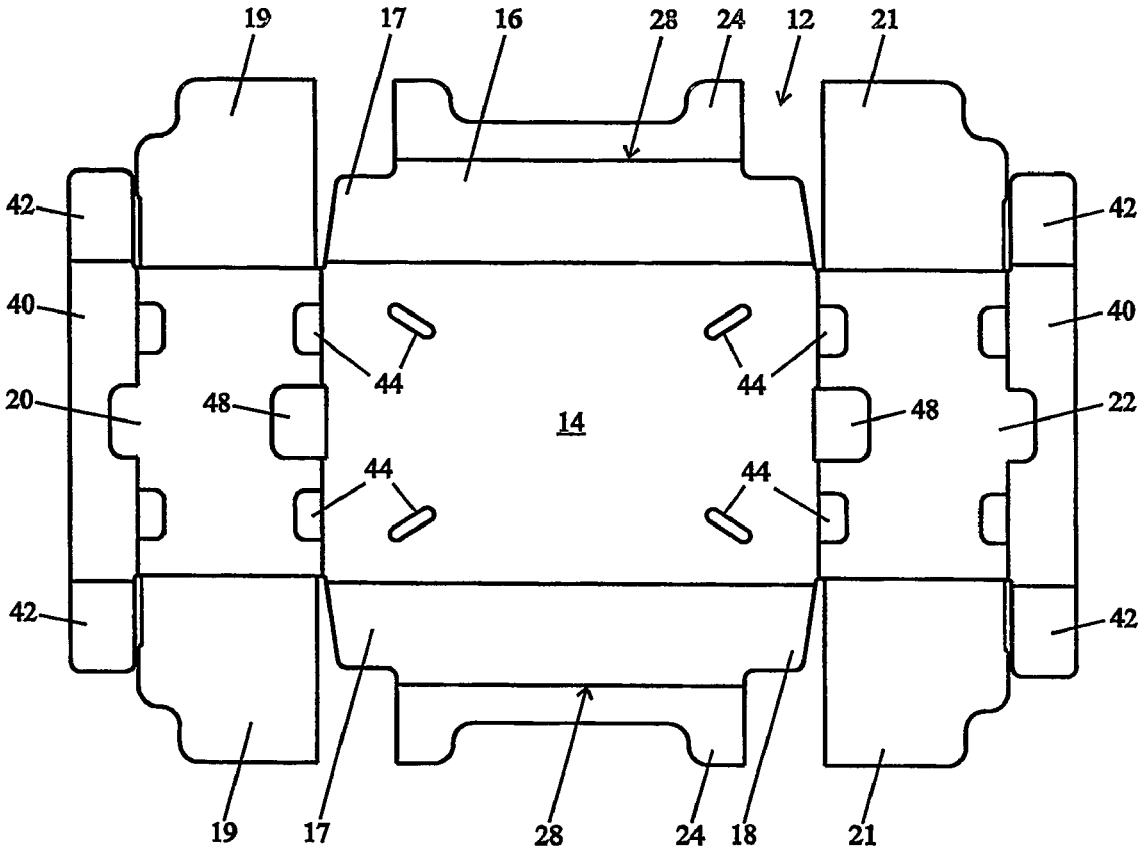
FIG. 1 shows a top plan view of a blank for a container according to the invention.
Figure 2:
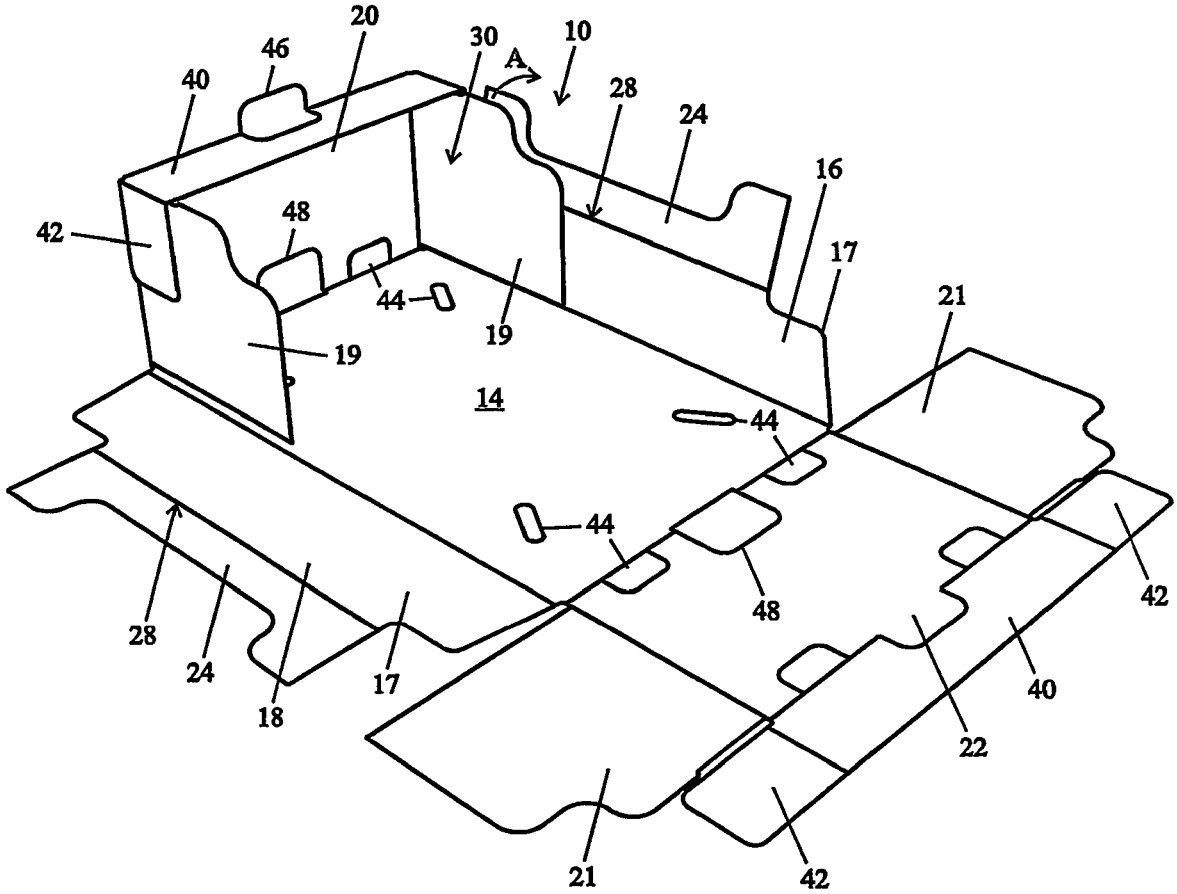
FIG. 2 shows a pictorial view of the blank in a first intermediate stage of folding the blank to form the container.

Referring now to FIG. 1, the blank 12 includes a base panel 14 and opposed first and second side wall panels 16 and 18 extending from the sides of the base panel 14. When folded into a vertical orientation, the first and second side panels 16 and 18 form the sidewalls of the container 10. First and second end wall panels 20 and 22 extend from each end of the base panel 14 and these end wall panels 20, 22 form the end walls of the container 10 when folded into a vertical orientation.

Inner side wall panels 19 and 21 are provided at each end of each end panel 20, 22.

The panels 16 and 18 each have a fold line 28 extending across them. The fold lines 28 sub-divide the panels 16 and 18 into sub-panels designated 17 and 24 and are formed by scoring the top face of the blank 12 as it is shown in FIG. 1. This scoring, being on the top face of the blank 12, thus faces the interior of the container 10 when erected and is known as reverse scoring. The fold line 28 made by this reverse scoring is known as a reverse score or a reverse crease.

The sub-panels 24 can thus be folded over and outwardly (see FIG. 4), during container erection, with respect to the sub-panels 17 to form flaps.

The container 10 does not have a full lid but is covered at each end by a top flap 40. The top flaps 40 are attached to those edges of the panels 20, 22 which are remote from the panel 14. Locking tabs 42 are provided at opposite ends of each top flap 40.

The blank is punched with ventilation holes at suitable places such as shown at 44. It is also cut so as to provide interlocking tabs 46 and openings 48 to receive the locking tabs 46 of a container on which it is stacked.

To erect the container 10 from the blank 12, the panels 20, 22 are folded upwardly so that they are vertical, and the panels 19, 21 folded inwardly so that they lie along the side edges of the base panel 14.

Figure 3:
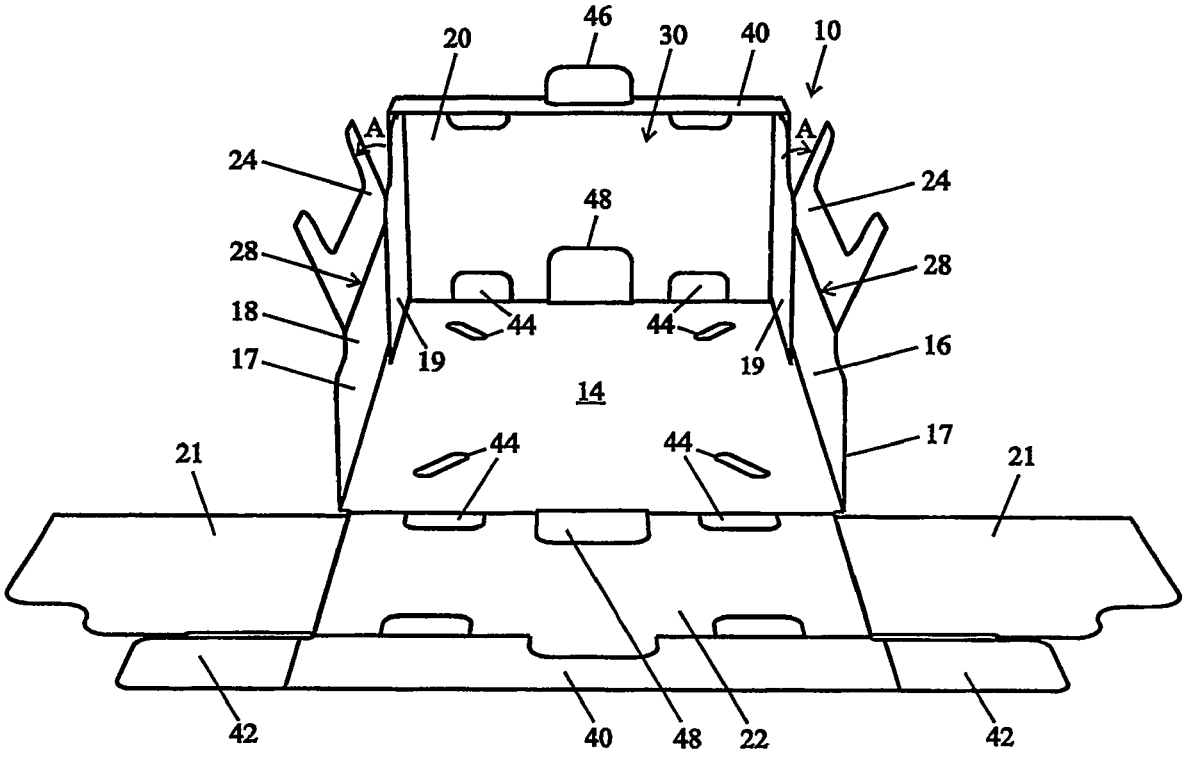
FIG. 3 shows a pictorial view of the blank in a second intermediate stage of folding the blank to form the container.
Figure 4:
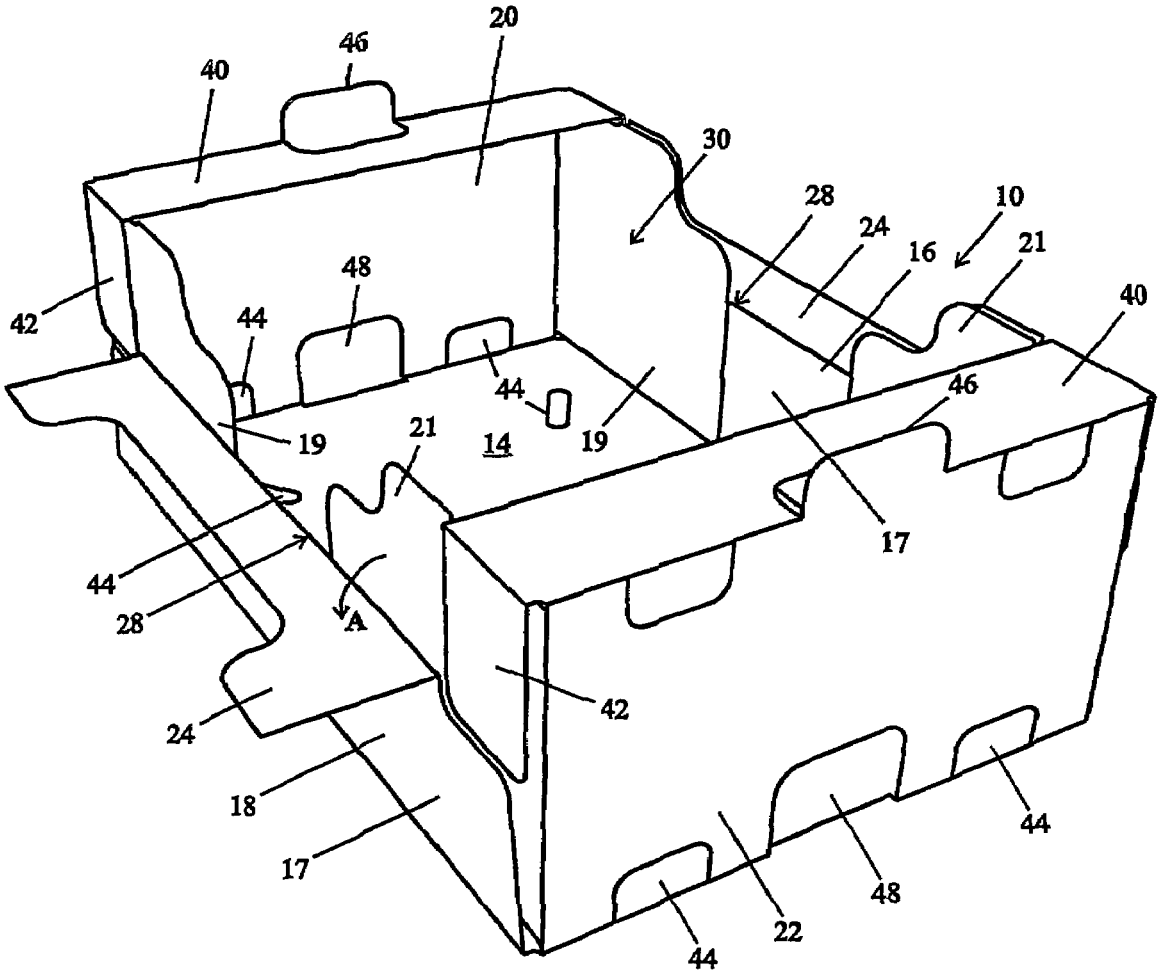
FIG. 4 shows a pictorial top view of the container.
Figure 5:
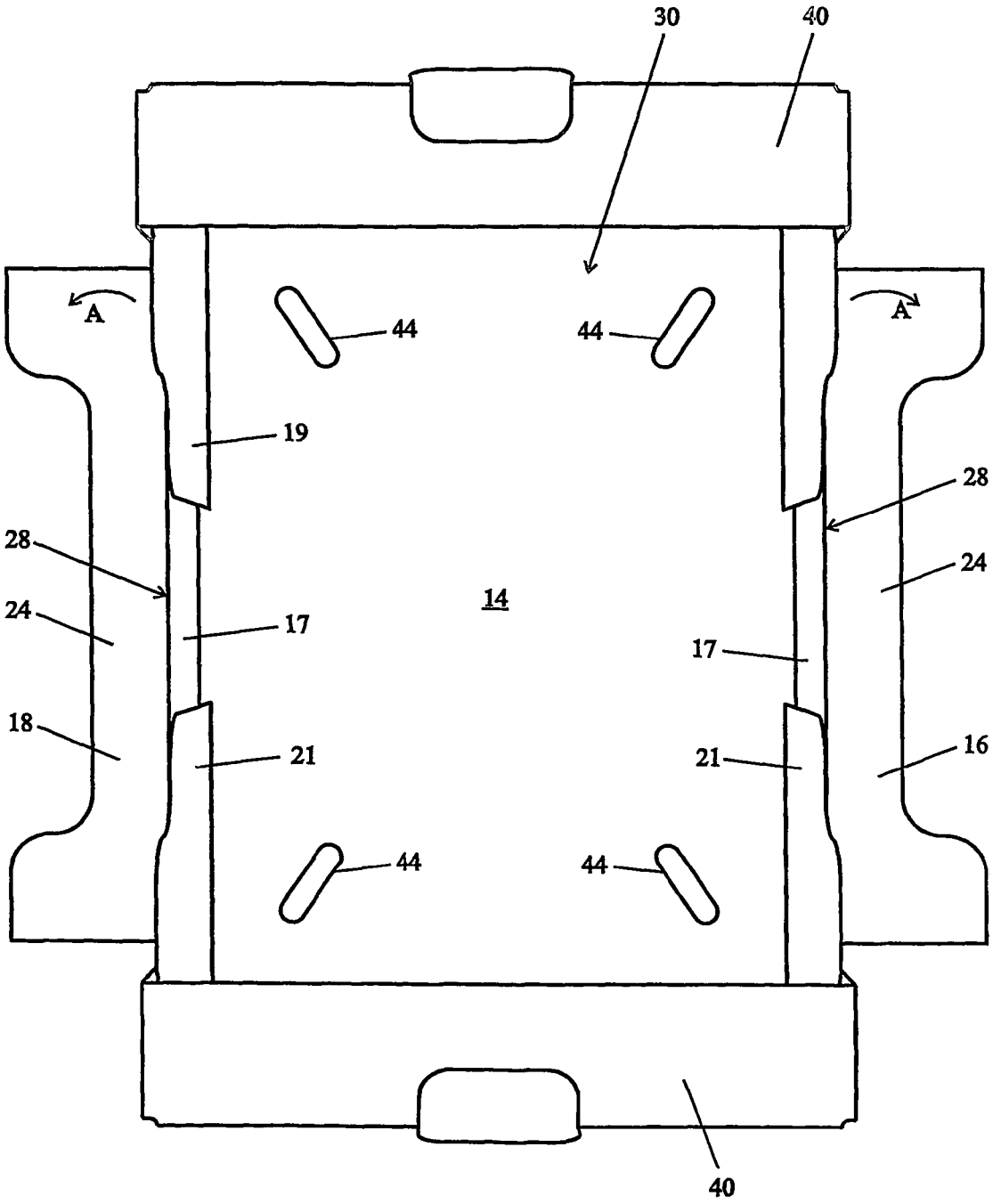
FIG. 5 shows a pictorial view of a container.

The side wall panels 16 and 18 are then folded upwardly and the sub-panels 24 bent outwardly as shown by arrow A in FIGS. 3 and 4. The panels 19, 21 lie inwardly of the panels 16, 18. The panels 16, 18 are secured to the panels 19, 21.

The top flaps 40 are folded over so as partially to close-off the open top 30 of the container and the tabs 42 are glued or stapled to the outer surfaces of the panels 19, 21.

A cover 29 (FIG. 6) has its edges secured between the sub-panels 24 and the inner side wall panels 19, 21. Adhesive, double-sided tape or staples can be used to secure the sub-panels 24 to the wall panels 19, 21 with the edges of the cover 29 between them.

The cover 29 can be in the form of a net, a header sheet, a length of plastics material or paper. It can cover the entire open top 30 of the container or only a part of it.

It will be understood that the cover 29, in most of the forms that it is used, allows the contents being transported in container 10 to be displayed and viewed at any time. Thus the fruit or other perishables may be viewed from when they are packed, until when they are removed by the consumer who has acquired the contents. It will further be understood that when the cover 29 is secured between the sub-panels 24, and the inner side wall panels 19, 21, the fold lines 28 are only slightly visible from the outside of container 10, as they are located on the inwardly facing surface of the panels 16 and 18 and are formed by reverse scoring.

The invention claimed is:

1. A container comprising a base panel; end wall panels upstanding from opposed ends of the base panel; side wall panels upstanding from opposed sides of the base panel; flaps attached to the end wall panels and extending along the side edges of the base panel inwardly of said side wall panels; and a cover extending over an open top of the container and having its edges secured between said side wall panels and said flaps, wherein each side wall panel has a horizontally extending crease line across it which sub-divides it into an upper panel part and a lower panel part, and wherein the cover is a net.

2. A container as claimed in claim 1, wherein the horizontally extending crease line is formed by a reverse score.

* * * * *